US005704471A

United States Patent [19]

Yamada

[11] Patent Number: 5,704,471

[45] Date of Patent: Jan. 6, 1998

[54] PACKET FOR WET TISSUE

[75] Inventor: Kikuo Yamada, Kanazawa, Japan

[73] Assignee: Chiyoe Yamada, Kanazawa, Japan

[21] Appl. No.: 530,904

[22] Filed: Sep. 20, 1995

[30] Foreign Application Priority Data

Aug. 4, 1995 [JP] Japan ..... 7-219753
Sep. 19, 1995 [JP] Japan ..... 7-264990

[51] Int. Cl.[6] ..... B65D 85/62

[52] U.S. Cl. ..... 206/207; 206/494; 206/812; 383/66

[58] Field of Search ..... 206/233, 494, 206/812, 205, 210, 207; 221/45, 63; 220/345, 346, 349; 229/125.12; 383/66, 69, 78

[56] References Cited

U.S. PATENT DOCUMENTS 1,628,981 5/1927 Horwitt .
2,290,597 7/1942 Leathers .
2,994,469 8/1961 Troup et al. ..... 383/64
4,094,456 6/1978 Raccaforte .
4,185,754 1/1980 Julius .
4,570,820 2/1986 Murphy ..... 221/45
5,158,635 10/1992 Schmierer et al. .
5,167,608 12/1992 Steffens, Jr. et al. .
5,383,556 1/1995 Van Loo ..... 220/345

FOREIGN PATENT DOCUMENTS 340172 12/1930 United Kingdom ..... 206/494

*Primary Examiner*—Jimmy G. Foster
*Attorney, Agent, or Firm*—Kanesaka & Takeuchi

[57] ABSTRACT

A packet for wet tissue, has a packet containing wet tissues, and a lid unit having a sliding lid for covering and uncovering a tissue dispensing opening. The lid unit is fitted in an opening formed in the pouch and is attached to the periphery of the opening. The lid unit has a base plate provided with the tissue dispensing opening and a lid supporting part formed so as to surround the tissue dispensing opening. The sliding lid is supported horizontally slidably on the lid supporting part to cover and uncover the tissue dispensing opening. The tissue dispensing opening is sealed when the lid is closed.

9 Claims, 15 Drawing Sheets

PACKET FOR WET TISSUE

BACKGROUND OF THE INVENTION AND DESCRIPTION OF THE RELATED ART

The present invention relates to a packet for wet tissue, containing wet tissues in a pouch so that the wet tissues can be taken out through a tissue dispensing opening one at a time and, more specifically, to a portable, disposable packet for wet tissue.

Wet tissues have become used prevalently for domestic purposes and business purposes in recent years and the consumption of wet tissues has been progressively increasing. Wet tissues are produced by impregnating sheets of fibers, such as sheets of nonwoven fabric, with impregnants, such as chemicals and cosmetic materials, and are used for cleaning or sterilizing hands, cleaning babies'hips and the like.

Conventional wet tissue containers are boxes and pouches. A box type wet tissue package is produced by packing folded wet tissues or a rolled wet tissue in a box formed by molding a hard or semirigid plastic material. The box is refillable.

A pouch type wet tissue package is produced by packing folded wet tissues in a pouch formed of an impervious film. The pouch type wet tissue package is portable and disposable.

A pouch type wet tissue package disclosed in Japanese Patent Publication No. 2-30948 is produced by packing wet tissues in a pouch formed of an impervious film. The pouch sealed by a central sealing seam and end sealing seams, is provided with a half-cut line for forming a tissue dispensing opening in its upper wall, and a flap-shaped cover of an impervious film having a back surface coated with an adhesive is attached adhesively to the upper surface so as to cover the cutting line. When the cover is pulled off the upper wall of the pouch to open the pouch, a portion of the upper wall demarcated by the half-cut line is clipped out of the upper wall to form a tissue dispensing opening. Although the clipped portion adheres to the adhesive back surface of the cover, the cover can adhesively be attached to the pouch again because the adhesive back surface has an adhesive area around the cover and the adhesive area sticks to the periphery of the tissue dispensing opening.

However, since the cover is attached adhesively to the pouch, dust adhering to the adhesive area of the adhesive back surface of the cover increases and the adhesion of the adhesive area decreases as the cover is removed from and attached to the pouch repeatedly and, consequently, the sealing effect of the cover deteriorates gradually. Since the pouch is formed of a soft, flexible plastic film, the periphery of the tissue dispensing opening is liable to be creased when the cover is opened and closed and it often occurs that the cover is closed by the adhesive back surface of the cover sticking to the creased film. Such a mode of covering brings about the deterioration of the sealing effect necessarily. The hermetic sealing performance of the cover is important for a wet tissue package. If the hermetic sealing performance of the cover is imperfect, the impregnants, such as chemicals and cosmetic materials, impregnated into the wet tissues dissipate by volatilization, which is a fatal disadvantage. The flap-shaped cover is not necessarily held in a horizontal position when opened. When the flap-shaped cover is opened, the resilience of the hinge portion urges the cover in a closing direction and hence the cover is liable to come into contact with the hand pulling out the wet tissue, which is a nuisance to the user and contaminates the adhesive back surface of the cover with the hand.

OBJECT AND SUMMARY OF THE INVENTION

It is an object of the present invention to provide a packet for wet tissue, formed by containing wet tissues in a pouch, provided with a cover capable of excellent sealing performance and maintaining satisfactory sealing effect even if the cover is opened and closed repeatedly.

Another object of the present invention is to provide a packet for wet tissue, facilitating actions to pull out the wet tissues and easy to use.

A packet for wet tissue according to the present invention comprises a pouch formed of an impervious film, a lid unit fitted in an opening formed in the pouch and attached to the pouch, and a stack of wet tissues contained in the pouch. The lid unit comprises a base plate provided with a tissue dispensing opening and a lid supporting part, and a lid horizontally slidably supported on the lid supporting part so as to cover and uncover the tissue dispensing opening. The lid is supported on the lid supporting part by a sliding rabbet structure, and the lid slides relative to the lid supporting part to cover or uncover the tissue dispensing opening.

Since the packet for wet tissue according to the present invention is provided with the lid unit comprising the base plate provided with the tissue dispensing opening and the lid supporting part, and the lid horizontally slidably supported on the lid supporting part so as to cover and uncover the tissue dispensing opening, the lid need not be provided with any adhesive and hence the lid is free from the trouble like the deterioration of the sealing performance of the prior art flap-shaped cover due to the deterioration of adhesion. Since a portion of the packet of the present invention around the tissue dispensing opening is not creased, the tissue dispensing opening can be surely hermetically covered without fail.

Since the lid of the packet for wet tissue of the present invention is easy to open and close, can be moved by one hand to cover and uncover the tissue dispensing opening, the packet is excellent in easiness of use and handling.

Since the lid of the packet for tissue of the present invention is moved horizontally to cover and uncover the tissue dispensing opening, the lid will not interfere with the action of hand for taking out the tissues and will not be a nuisance to the user.

The prior art packet provided with the flap-shaped cover is pulled up when the cover is pulled up by one hand because the weight of the packet decreases as the tissues are used and it is difficult to open the cover. Since the lid of the packet of the present invention is moved horizontally to cover and uncover the tissue dispensing opening, the lid can be easily opened by one hand even if the packet is light, which facilitates the use of the packet.

DETAILED DESCRIPTION OF THE PREFERRED EMBODIMENTS

The present invention will be described in detail with reference to the accompanying drawings.

Figure 1:
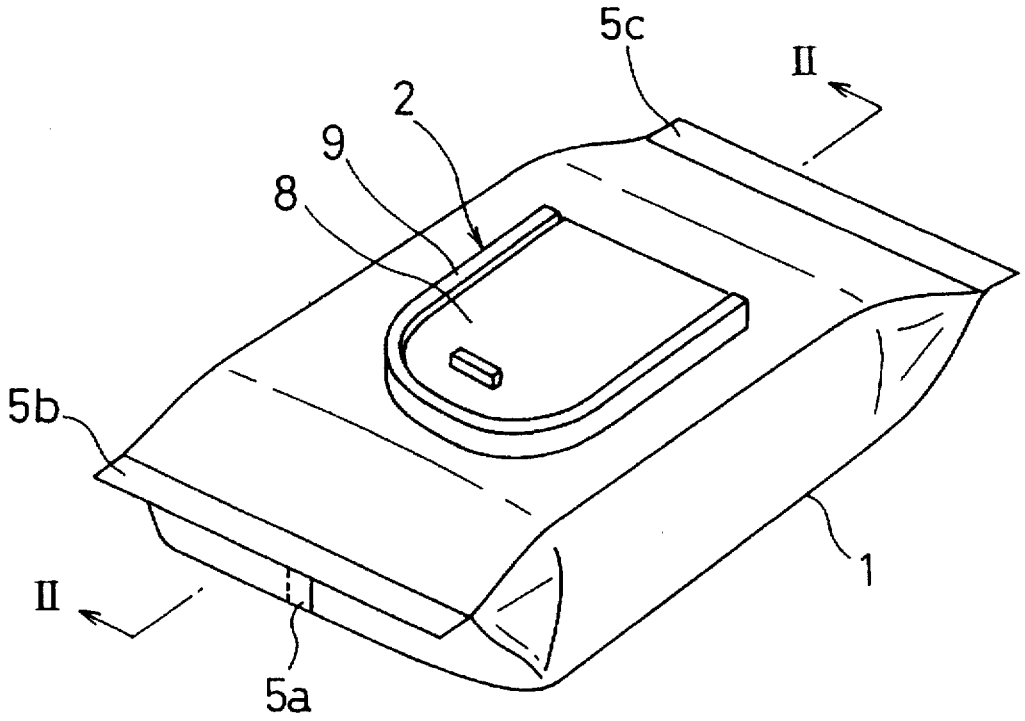
FIG. 1 is a perspective view of a packet for wet tissue in a preferred embodiment according to the present invention.
Figure 2:
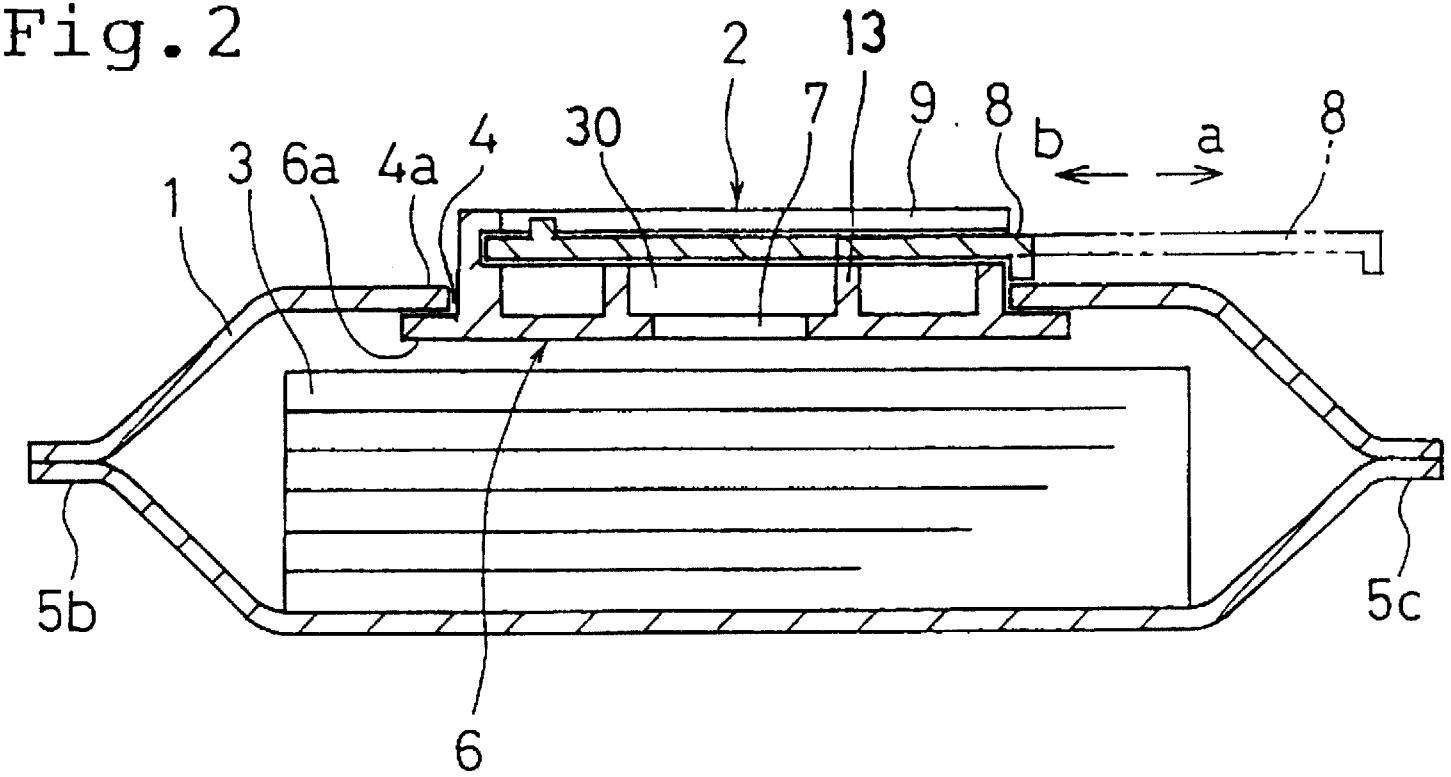
FIG. 2 is a longitudinal sectional view taken on line II—II in FIG. 1

Referring to FIGS. 1 and 2 showing a packet for wet tissue in a first embodiment according to the present invention, there are shown a pouch 1, a lid unit 2 and a stack 3 of wet tissues contained in the pouch 1. The pouch 1 is formed of an impervious film, i.e., a film impervious to chemicals and cosmetic materials impregnated into the wet tissues and capable of preventing the exudation and volatilization of the same. Suitable films for forming the pouch 1 are plastic films, such as those of polyethylene, polypropylene, polyester, polyamide, vinyl chloride, vinylidene chloride, cellophane and acetate, laminated films of combinations of a plurality of those plastic films, composite films formed by laminating those plastic films and aluminum foil, and composite films formed by laminating those composite films and aluminum foil. Preferably, in case of laminated films and composite films, one surface of the films is formed of a heat-sealable material.

The lid unit 2 is fitted in an opening 4 formed in the upper wall of the pouch 1 and attached to the upper wall of the pouch 1. The lower surface of the periphery 4*a* of the opening 4 is attached to the upper surface of the periphery 6*a* of a base plate 6 included in the lid unit 2 by joining means, such as heat-sealing, high-frequency sealing, ultrasonic sealing or adhesive sealing. Heat-sealing is most preferable. The lower surface of the periphery 6*a* of the base plate 6 may be joined to the upper surface of the periphery 4*a* of the opening 4. The lid unit 2 is joined to a film for forming the pouch 1 in a process of forming the pouch 1. The film is punched to form the opening 4, the lid unit 2 is put in the opening 4, and then the lid unit 2 is joined to the film by joining means, such as heat-sealing. The stack 3 of wet tissues is wrapped in the film joined to the lid unit 2, an overlapping portion 5*a* of the film is fastened by joining means, such as heat-sealing, and opposite overlapping longitudinal ends 5*b* and 5*c* are joined by joining means, such as heat-sealing, to complete the pouch 1. Preferably, the components of the lid unit 2 are formed of a hard or semirigid thermoplastic resin, such as polypropylene or polyethylene. For example, the base plate 6 and the lid 8 can be formed of a thermoplastic resin by injection molding. Materials for forming the components of the lid unit are not limited to plastic materials, but may be materials other than plastic materials.

The stack 3 of wet tissues is formed by stacking a plurality of square wet tissues in layers. Generally, wet tissues folded in three are stacked so that the lower leaf of the overlying folded wet tissue overlaps the upper leaf of the underlying folded wet tissue to enable the pop-up dispensing of the wet tissues from the pouch 1. The wet tissues are produced by impregnating impregnants, such as chemicals and cosmetic materials, into or applying such impregnants to paper sheets, nonwoven sheets, sheets of fabric, cotton sheets, sheets of gauze, foam sheets or the like. One of the chemicals is, for example, is a disinfecting alcohol.

The lid unit 2 of the packet may be of any shape and any construction, provided that the lid unit 2 comprises a base plate 6 provided with a tissue dispensing opening 7 and a lid supporting part 9 formed around the tissue dispensing opening 7, and a lid 8 horizontally slidably supported on the lid supporting part 9 and capable of covering and uncovering the tissue dispensing opening 7. The lid unit 2 may be provided with a single lid that is moved horizontally relative to the tissue dispensing opening 7 in one direction to uncover the tissue dispensing opening 7 and moved in the opposite direction to cover the tissue dispensing opening 7 as shown in FIGS. 1 and 2, may be a lid consisting of two half lids that can be horizontally moved in opposite directions, respectively, to cover and uncover the tissue dispensing opening, or a lid that can be turned on an axis extending near the tissue dispensing opening to cover and uncover the tissue dispensing opening.

In the description of the packet, "horizontal"means parallel to a plane including the surface in which the tissue dispensing opening is formed. The lid need not necessarily be movable in the directions perfectly parallel to the plane including the surface in which the tissue dispensing opening is formed, but may be movable in the directions at a small angle to the plane including the surface in which the tissue dispensing opening is formed; that is, the lid may be moved slightly obliquely upward or downward at a small angle to the plane including the surface in which the tissue dispensing opening is formed to uncover the tissue dispensing opening, provided that such an arrangement of the lid does not increase the thickness of the lid unit greatly.

Figure 3:
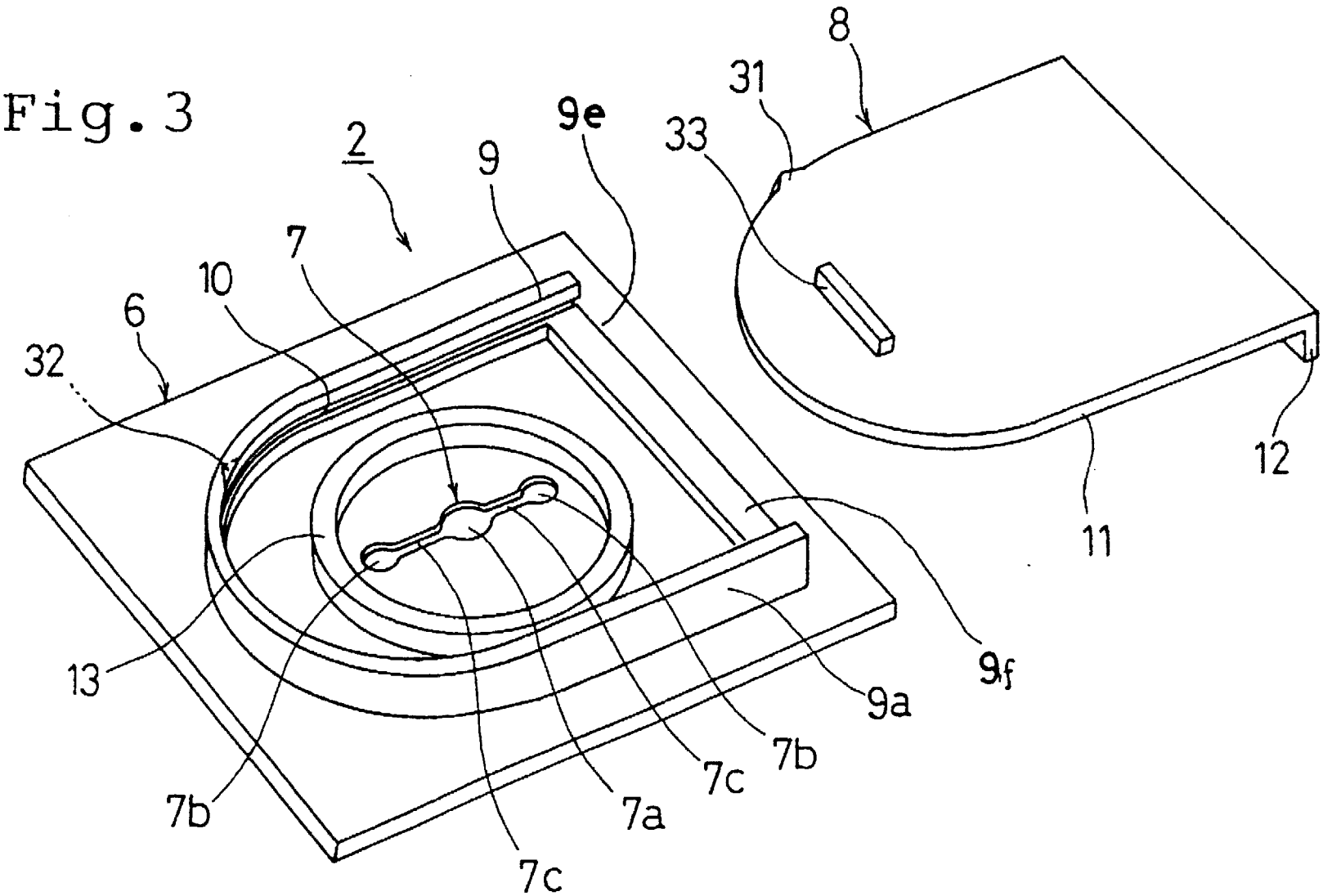
FIG. 3 is an exploded perspective view of a lid unit included in the packet of FIG. 1.

In this packet, the lid 8 is supported for horizontal sliding movement on the lid supporting part 9 by a sliding rabbet structure as shown in FIG. 3, in which the side edges of the lid 8 are slidably fitted in grooves 10 formed in the lid support part 9. Referring to FIG. 3, the lid supporting part 9 has a U-shaped wall 9*a* standing on the base plate 6 so as to surround the three sides of the tissue dispensing opening 7, and a groove 10 formed in the inner side surface of the wall 9*a*. The lid 8 has an external shape corresponding to the shape of the lid supporting part 9, and a thickness substantially corresponding to the width of the groove 10. A tongue 11 formed on the edge of the lid 8 fits the groove 10. The respective tolerances of the width of the groove 10 of the lid supporting part 9 and the thickness of the tongue 11 of the lid 8 are determined so that the lid 8 is able to slide smoothly along the groove 10 and to seal the tissue dispensing opening 7 hermetically when the lid 8 is closed. The tongue 11 of the lid 8 is inserted in the groove 10 through the open end 9*e* of the lid supporting part 9 and the lid 8 is moved along the groove 10 as far as the front end of the lid 8 strikes on the inner end of the lid supporting part 9 to set the lid at its closed position as shown in FIG. 2. An entrance threshold 9*f* is formed at the open end 9*e* of the lid supporting part 9. The lower surface of the lid 8 is in sliding contact with the upper surface of the entrance threshold 9*f*. The tissue dispensing opening 7 is surrounded by a circular inner wall 13. The sealing effect of the lid unit 2 is secured by the engagement of the groove 10 of the lid supporting part 9 and the tongue 11 of the lid 8, and the contact between the entrance threshold 9*f* of the lid supporting part 9 and the rear end of the lid 8; that is, the tissue dispensing opening 7 is sealed substantially hermetically by forming the lid 8 and the groove 10 of the lid supporting part 9 so that the tongue 11 of the lid 8 is closely fitted in the groove 10 of the lid supporting part 9 in a close running fit, and forming the lid 8 and the entrance threshold 9*f* so that the rear end of the lid 8 is in close contact with the entrance threshold 9*f*.

Figure 17A:
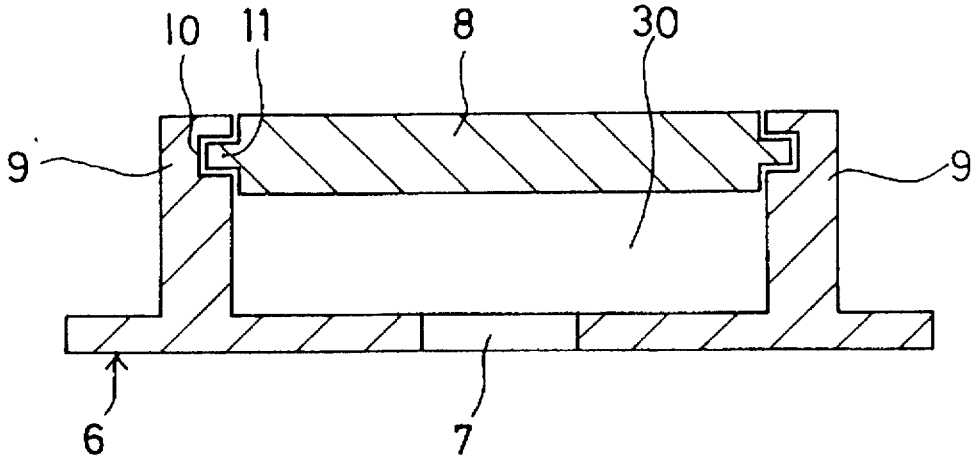
FIGS. 17(A), 17(B) and 17(C) are longitudinal sectional views of sliding lid supporting structures in first, second and third examples in accordance with the present invention, respectively.
Figure 17B:
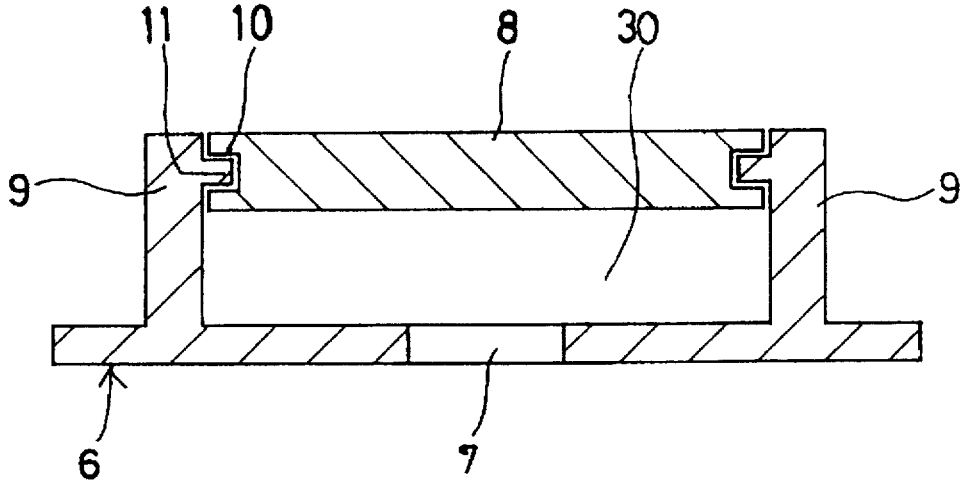
Figure 17C:
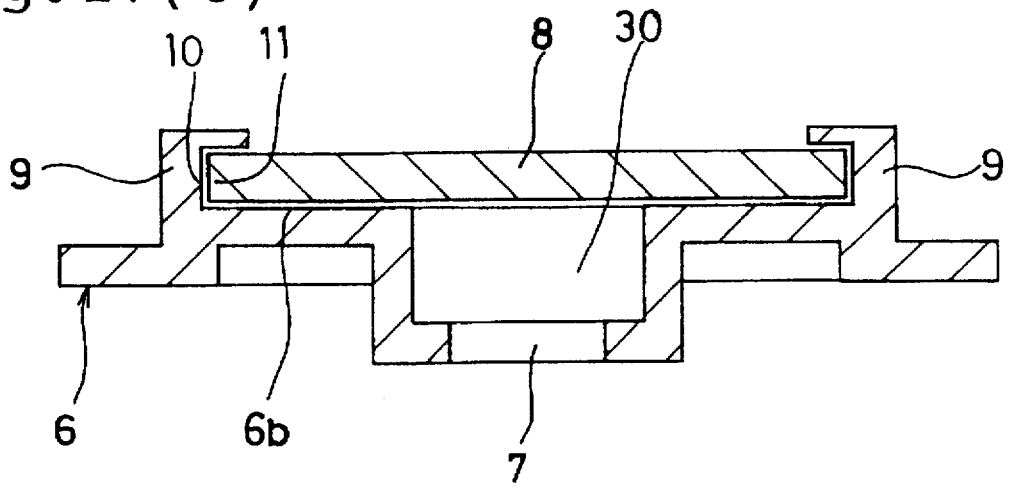

The sliding rabbet structure of the lid unit 2 need not necessarily be limited to that shown in FIG. 3, but may be, for example, any one of sliding rabbet structures as shown in FIGS. 17(A), 17(B) and 17(C). A lid unit shown in FIG. 17(A) has a tongue-and-groove structure consisting of a tongue 11 formed along the edge of a lid 8, and a corresponding groove 10 formed in the inner surface of a lid supporting part 9. A lid unit shown in FIG. 17(B) has a tongue-and-groove structure consisting of a tongue 11 formed on the inner surface of a lid supporting part 9, and a corresponding groove 10 formed in the edge of a lid 8. A lid unit shown in FIG. 17(C) has a tongue-and-groove structure consisting of the edge 11 of a lid 8 serving as a tongue, and a corresponding groove 10 formed in the inner surface of a lid supporting part 9. In the lid unit shown in FIG. 17(C), the lid supporting part 9 has platforms 6*b* formed by extending the lower surfaces of the groove 10, and the lid 8 is in contact with the upper surfaces of the platforms 6*b* as well as with the surfaces of the groove 10, so that the sealing effect of the lid 8 is enhanced and the stable sliding movement of the lid is ensured. The lid units shown in FIGS. 17(A) and 17(B) may be provided with a plurality of sets each of a tongue and a groove. Although the tongue may be an interrupted tongue, a continuous tongue is desirable in view of sealing performance. In each of the lid units shown in FIGS. 17A), 17(B) and 17(C), the lid 8 is slidably fitted inside the lid supporting part 9. However, the lid 8 may be slidably supported on the outer side of the lid supporting part 9.

Figure 20A:
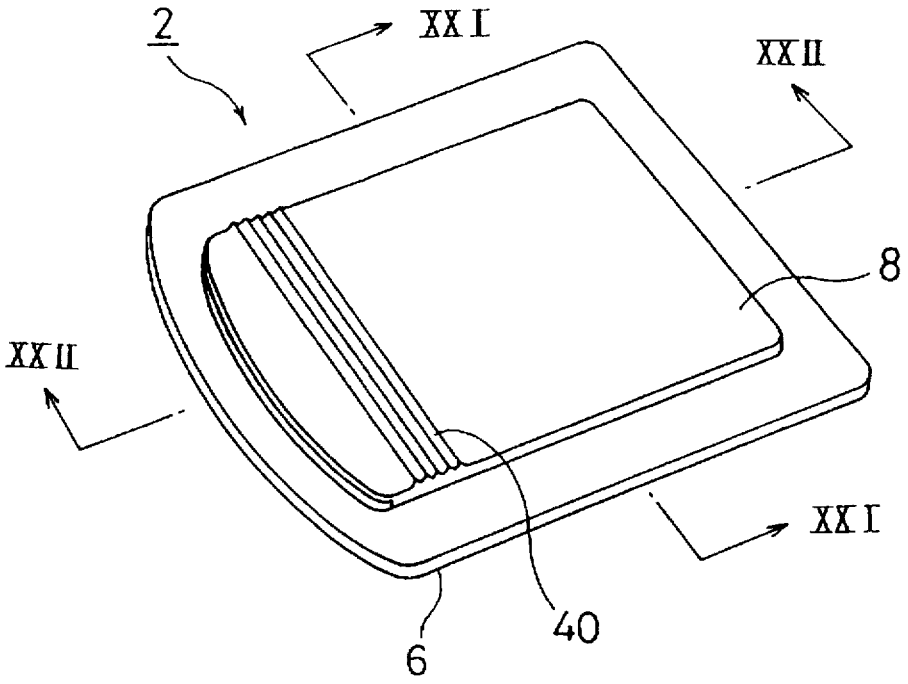
FIGS. 20(A) and 20(B) are perspective views of a lid unit included in a packet for wet tissue in a fifth embodiment according to the present invention in a closed state and in an open state, respectively.
Figure 20B:
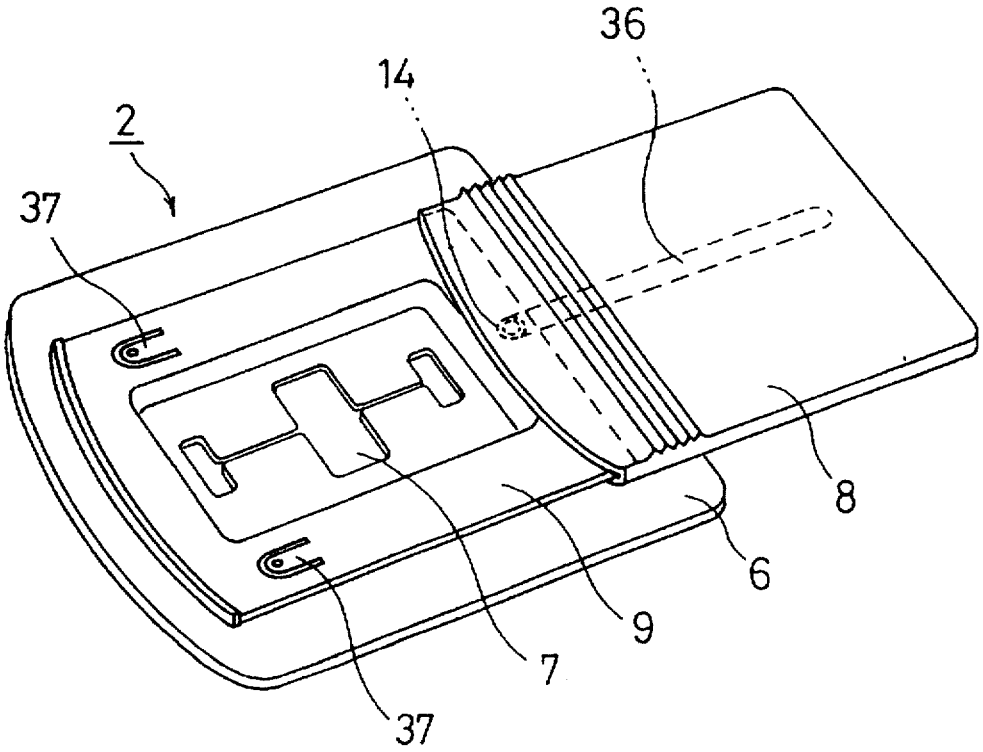
Figure 21:
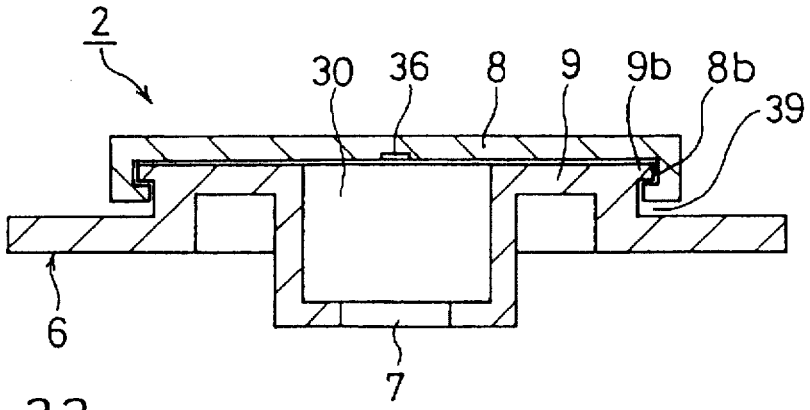
FIG. 21 is a longitudinal sectional view taken on line XXI—XXI in FIG. 20(A)

FIGS. 20(A), 20(B), 21, 22 and 23 show lid units in which a lid is supported on the outer side of a lid supporting part 9. Referring to FIGS. 20(A), 20(B) and 21, a lid unit 2 comprises a lid 8 having the opposite longitudinal sides curved downward in a U-shape to form inner grooves 8*b*, and a base plate 6 having a lid supporting part 9 having side flanges 9*b* protruding outward from the upper part thereof. The lid 8 is put on the lid supporting part 9 so that the side flanges 9*b* of the lid supporting part 9 are received in a sliding engagement in the inner grooves 8*b* of the lid 8. The lid 8 slides horizontally along the side flanges 9*b* and the upper surface of the lid supporting part 9. As shown in FIG. 21, spaces 39 are formed between the lower surfaces of the U-shaped sides defining the grooves 8*b* and the upper surface of the base plate 6 when the lid 8 is supported on the lid supporting part 9 to space the lower surfaces of the U-shaped sides of the lid 8 from the film forming the pouch 1 when the base plate 6 is joined to the inner surface of the periphery of the opening of the pouch to attach the lid unit 2 to the pouch 1 in order that the lid 8 is able to slide smoothly without touching the film forming the pouch 1.

Figure 11:
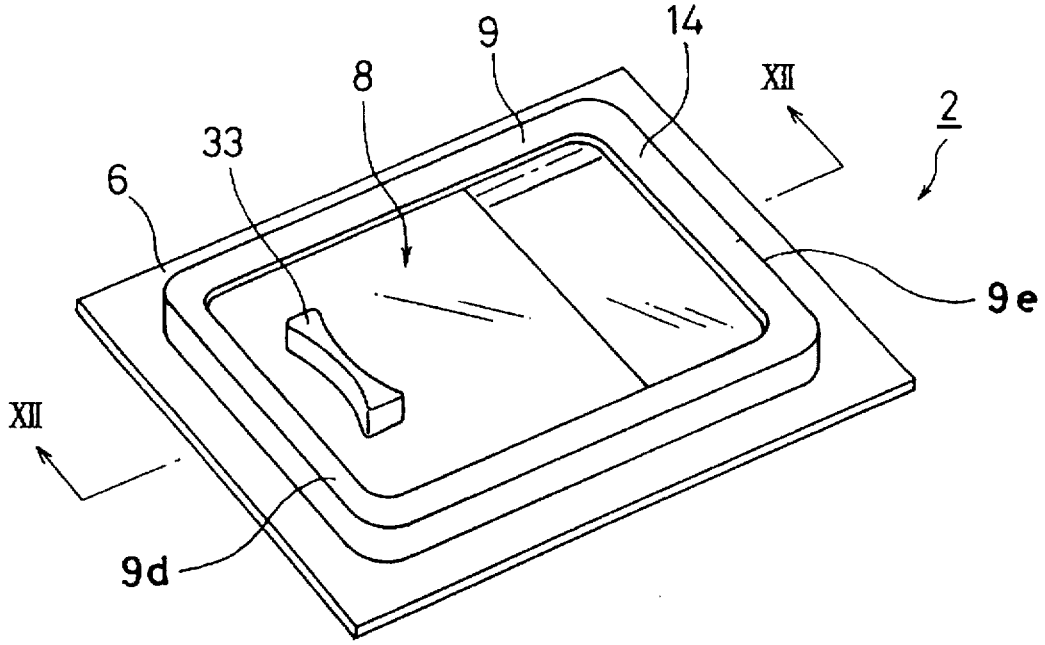
FIG. 11 is a perspective view of a lid unit included in a packet for wet tissue in a third embodiment according to the present invention.
Figure 22:
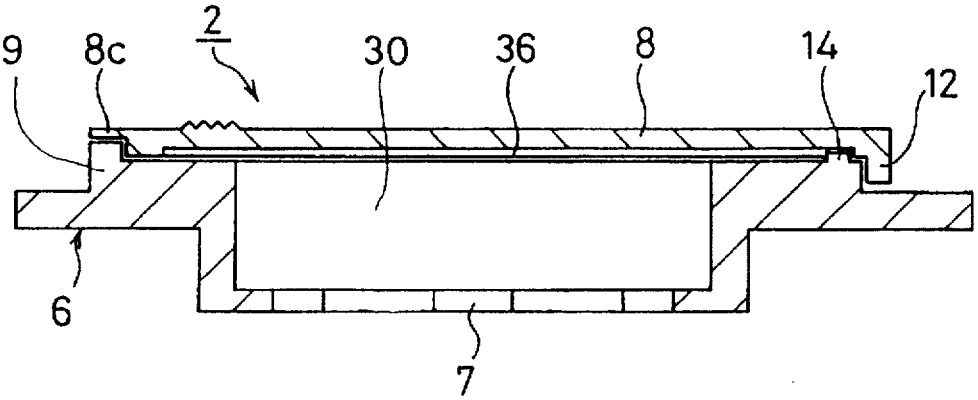
FIG. 22 is a longitudinal sectional view taken on line XXII—XXII in FIG. 20(A)

The lid 8 may be of any shape, provided that the lid 8 is able to fully cover the tissue dispensing opening 7. For example, the lid 8 may be a plate having a shape of a combination of a square and a semicircle as shown in FIG. 3, a semicircular plate or a substantially square plate as shown in FIG. 11. When the lid 8 has a square shape, a sliding rabbet structure may be formed so that at least the opposite side edges of the lid 8 are slidably engaged with the lid supporting part 9, and the front edge of the lid 8 need not necessarily be supported by a tongue-and-groove structure as shown in FIG. 3. As shown in FIGS. 20(B) and 22, the lid may be formed in a substantially square shape, the opposite sides of the lid 8 may be supported slidably on the lid supporting part 9 so as to form a tongue-and-groove structure, a lower portion of the front side 8*c* of the lid 8 may be removed so as to form a stepped portion, and the lid supporting part 9 may be provided on its upper surface with a flat ridge of a height corresponding to the thickness of the removed lower portion of the front side 8*c*.

In a lid unit in accordance with the present invention, a lid need not necessarily be supported for horizontal movement by a sliding rabbet structure. For example, a lid supporting part may be formed so that the lower surface of a lid is in contact with the upper surface of the lid supporting part when the lid is at its closed position, and the lid may be supported on a base plate for turning in a horizontal plane instead of being supported by a sliding rabbet structure. In this lid unit, a tissue dispensing opening is sealed by the lid in contact with the lid supporting part, and the tissue dispensing opening can be covered and uncovered by turning the lid in a horizontal plane.

According to the present invention, the tissue dispensing opening can be satisfactorily sealed by the sliding rabbet structure formed by the lid and the lid supporting part, and the close contact between the lid and the lid supporting part. Therefore, the sealing effect of the lid unit can be enhanced by increasing the surface areas of portions of the components forming the sliding rabbet structure and portions of the same in contact with each other. Means for enhancing the tissue dispensing opening sealing effect of the lid unit will be concretely described below.

For example, as shown in FIG. 3, the rear end of the lid 8 is bent downward at a right angle with respect to the lower surface of the lid 8 to form a contact wall 12 that comes into contact with the outer side surface of the entrance threshold 9*f* when the lid 8 is fully inserted in the lid supporting part 9. The contact of the lid 8 with both the upper surface and the outer side surface of the entrance threshold 9*f* of the lid supporting part 9 enhances the sealing effect of the lid unit 1.

Figure 4:
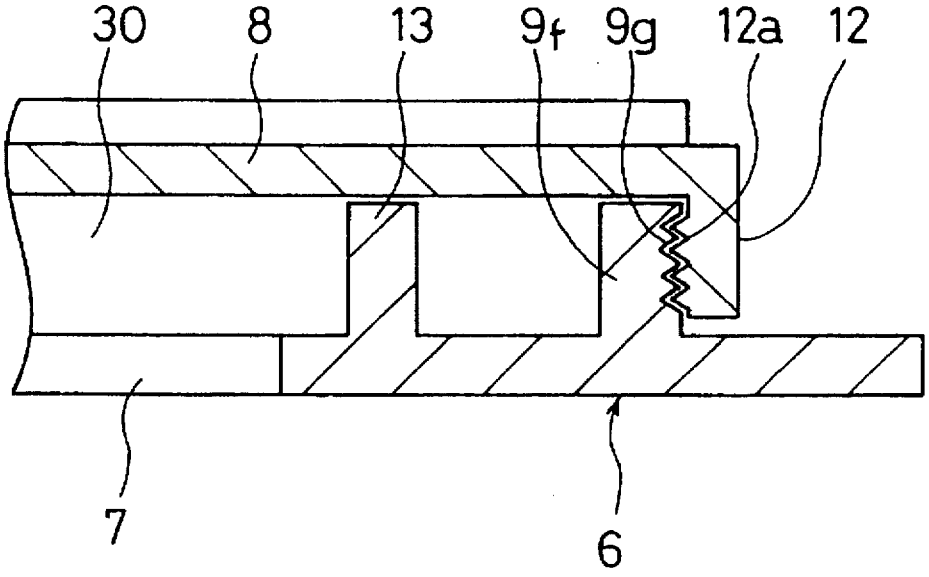
FIG. 4 is a fragmentary longitudinal sectional view of the lid unit of FIG. 3, in which a lid is slidably fitted on a lid supporting part.

The outer side surface of the entrance threshold 9f and the inner surface of the contact wall 12 may be provided with mating ridge-and-furrow patterns 9g and 12g, respectively, as shown in FIG. 4 to further increase the area of contact between the lid 8 and the lid supporting part 9. Since the contact wall 12 is formed at the rear end of the lid 8, the contact wall 12 and the ridge-and-furrow patterns 9g and 12g do not affect adversely to the sliding movement of the lid 8. The area of contact between the lid 8 and the lid supporting part 9 can be increased by forming the upper surfaces of all the sides of the lid supporting part 9 surrounding the tissue dispensing opening 7 in a large width as shown in FIG. 20(B). The wide upper surfaces of the sides of the lid supporting part 9 is able to support the lid securely and to prevent the lid 8 from being strained or warped when the lid 8 slides, so that the lid 8 is able to slide smoothly.

The base plate 6 may be provided with a circular wall 13 surrounding the tissue dispensing opening 7 in an area surrounded with the lid supporting part 9. The circular wall 13 is formed so that its upper surface is in contact with the lower surface of the lid 8 as shown in FIG. 2 to seal a space 30 surrounded by the circular wall 13. The size of the space 30 defined by the circular wall 13 and the lid 8 can be optionally determined to enhance the tissue dispensing opening sealing effect of the lid 8.

The lid unit 2 may be provided, for example, with a lid retaining means comprising a small protrusion 31 formed on the tongue 11 of the lid 8, and a recess 32 formed in the inner surface of the lid supporting part 9 at a position corresponding to the protrusion 31 of the lid 8 when the lid 8 is at its closed position so that the protrusion 31 drops into the recess 32 to retain the lid 8 at the closed position and to restrain the lid 8 from accidental sliding in the opening direction. The shapes of the protrusion 31 and the recess 32 are determined so that the protrusion 31 may not be disengaged from the recess 32 when the packet is shook and can be easily disengaged from the recess 32 when a lid opening force is applied to the lid 8 by the tip of a finger.

Figure 13:
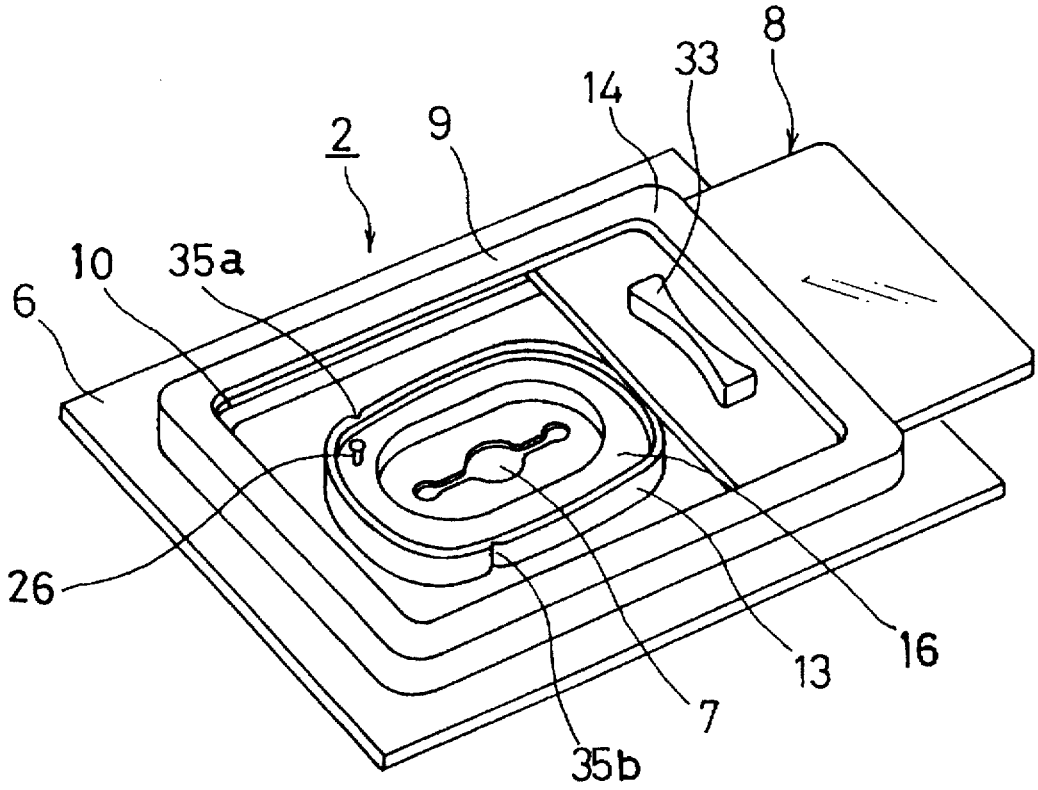
FIG. 13 is a perspective view of the lid unit of FIG. 11, in which the lid is at its open position.
Figure 14:
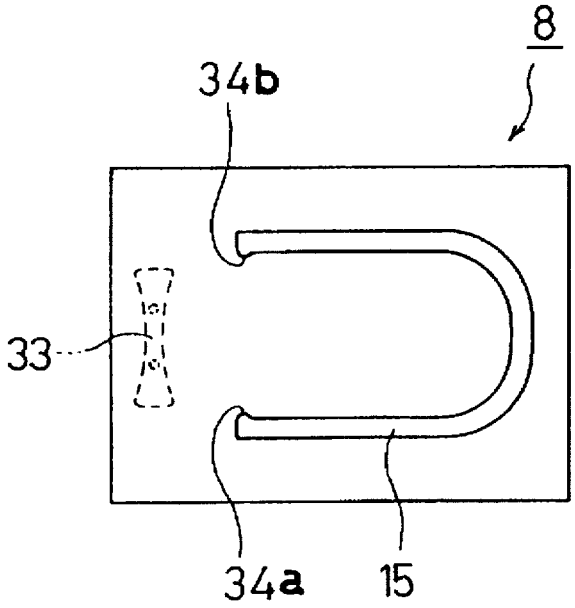
FIG. 14 is a rear view of a lid included in the lid unit of FIG. 11.
Figure 23:
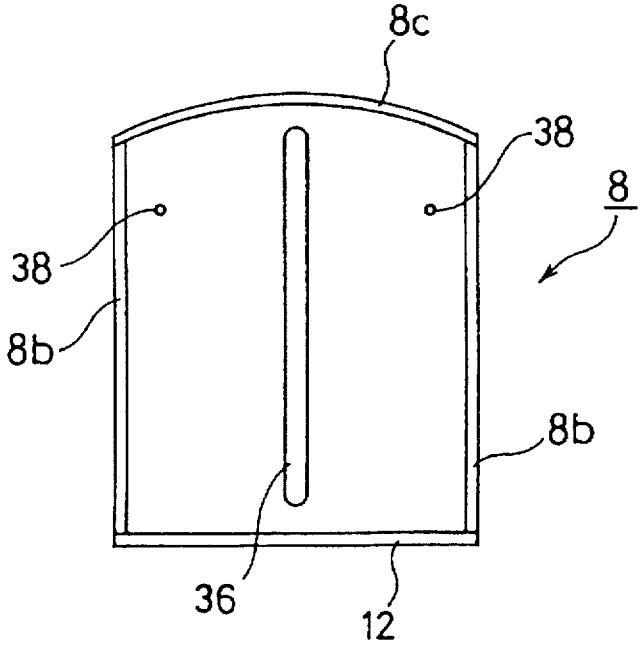
FIG. 23 is a rear view of a lid included in the lid unit of FIG. 20(A).

Another lid retaining means for restraining the lid 8 from sliding movement in the opening direction may comprise U-shaped tongues 37 each provided with a protrusion on its upper surface and formed by raising portions of the upper surface of the lid supporting part 9 as shown in FIG. 20(B), and recesses 38 formed on the lower surface of the lid 8 as shown in FIG. 23 so as to coincide with the protrusions of the tongues 37, respectively, when the lid 8 is closed. When the lid 8 is moved in the opening direction or the closing direction, the tongues 37 are depressed so that the tongues 37 do not affect the smooth sliding movement of the lid 8. When the lid 8 is moved to its closed position, the protrusions of the tongues 37 are caused to snap into the recesses 38 of the lid 8 by the resilience of the tongues 37 to retain the lid 8 at the closed position. As shown in FIG. 14, the lid 8 of a lid unit 2 shown in FIG. 13 is provided on its lower surface with a U-shaped ridge 15 provided with small protrusions 34a and 34b on the inner surfaces of the opposite ends of the ridge 15, and the inner wall 13 of the lid unit 2 is provided with recesses 35a and 35b so as to coincide with the protrusions 34a and 34b, respectively, when the lid 8 is closed. When the lid 8 is closed, the small protrusions 34a and 34b snap into the recesses 35a and 35b, respectively, to retain the lid 8 at its closed position. The lid 8 may be provided on its upper surface with a knob 33 to facilitate sliding the lid 8. The lid 8 may be provided in its upper surface with a nail nick, not shown, or knurls for preventing a finger from slipping, such as saw-tooth ridges 40 as shown in FIGS. 20(A) and 20(B).

Figure 18:
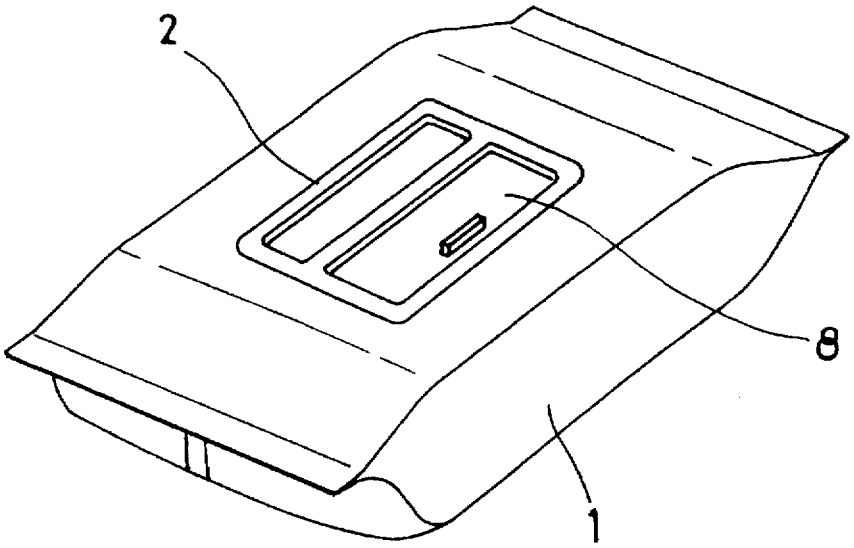
FIG. 18 is a perspective view of a packet for wet tissue in a fourth embodiment according to the present invention.
Figure 19:
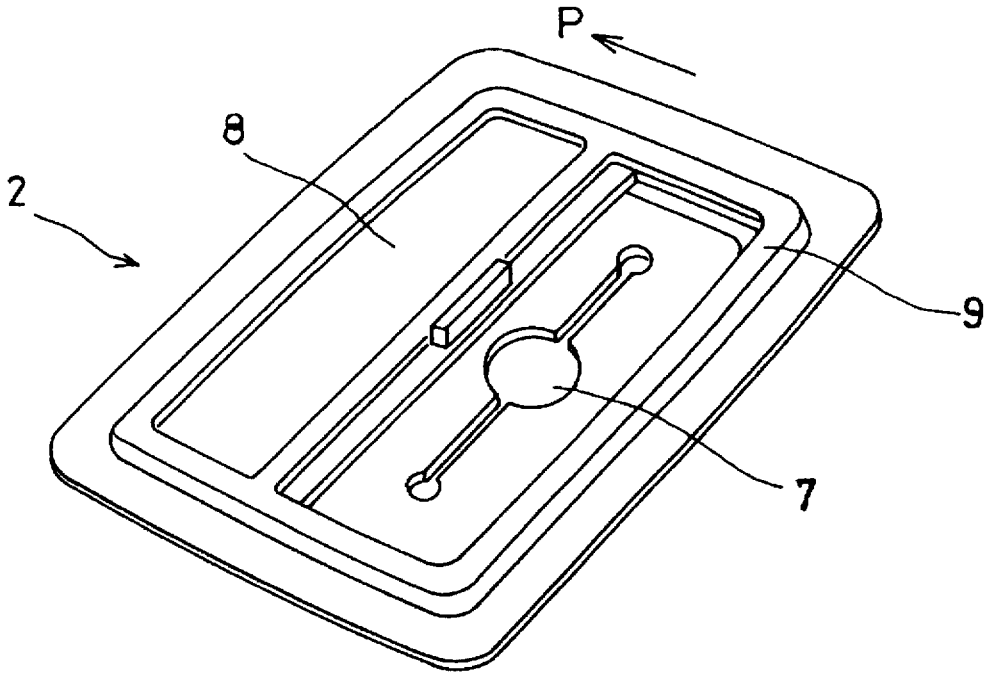
FIG. 19 is a perspective view of a lid unit included in the packet of FIG. 18, in which a lid is at its open position.

Although the lid unit 2 of the packet shown in FIG. 1 is fitted in the opening 4 of the pouch 1 and attached to the pouch 1 so that the lid 8 slides longitudinally of the pouch 1, the lid unit 2 need not necessarily be attached to the pouch 1 in such a position, and the lid unit 2 may be attached to the pouch 1 so that the lid 8 slides transversely of the pouch 1 as shown in FIG. 18. The lid unit 2 may be formed so that the lid 8 does not project from the lid unit 2 when opened. As shown in FIG. 19, when the lid 8 and the lid supporting part 9 are formed in sizes only sufficient for covering the tissue dispensing opening 7 and the lid unit 2 is formed so that the lid 8 slides transversely of the tissue dispensing opening 7, i.e., in the direction of the arrow P, through a short sliding distance of the lid, the lid unit 2 has a comparatively small width. Such a lid unit 2 having a comparatively small width can be formed in a comparatively small size and contributes to forming a lightweight packet having excellent aesthetic appearance.

Figure 12A:
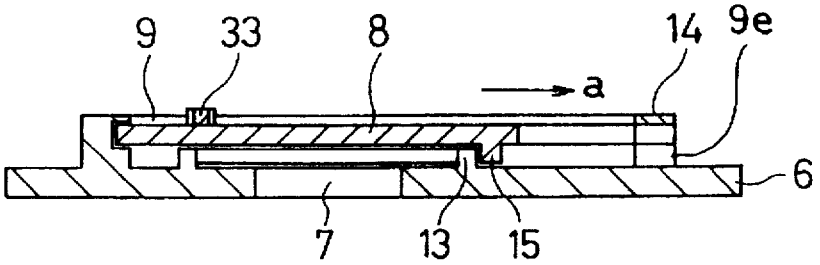
FIGS. 12(A) and 12(B) are longitudinal sectional views taken on line XII—XII in FIG. 11 in an open state and in a closed state, respectively.
Figure 12B:
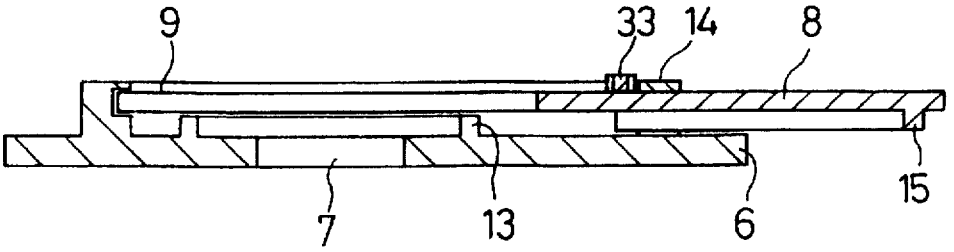

The lid unit 2 of the packet is formed so that the lid 8 does not slip out of the lid supporting part 9 when opened. For example, as shown in FIG. 11, the lid 8 is provided with a knob 33 on its upper surface, and the lid supporting part 9 is provided with a stopper 14 on its inlet side 9e so that the knob 33 strikes against the stopper 14 when the lid 8 is moved to its open position. When the lid 8 at its closed position as shown in FIG. 12(A) is pulled at the knob 33 in the opening direction, the knob 33 comes into contact with the stopper 14 disposed on the inlet side 9e as shown in FIG. 12(B) to limit the movement of the lid 8 in the opening direction. In the lid unit 2 shown in FIG. 11, the groove 10 of the lid supporting part 9 is formed also in the inner surface of the section 9d opposite the inlet side 9e, so that the three sides of the lid 8 excluding the rear side of the same are received in the groove 10 when the lid 8 is closed. Although the lid supporting part 9 of the lid unit 2 is not provided with any wall on the inlet side 9e, the tissue dispensing opening 7 can be sealed by the contact between the upper surface of the inner wall 13 of the base plate 6 and the lower surface of the lid 8. FIG. 14 is a rear view of the lid 8 of the lid unit 2 shown in FIG. 11. As shown in FIG. 14, the lid 8 is provided on its lower surface with a U-shaped ridge 15 having an open front end. The U-shaped ridge 15 extends around and comes into contact with the outer circumference of the inner wall 13 of the base plate 6 when the lid 8 is closed. The lid 8 is not provided with the ridge 15 on its leading end to be inserted in the inner wall. The ridge 15 is fitted in the outer side of the inner wall 13. When assembling the lid unit 2, the lid 8 not provided with the knob 33 is inserted through the inlet side 9e to be fitted in the groove 10 in the lid supporting part 9, the lid 8 is held with a position where the knob 33 is to be attached to the lid 8 contiguous with the inner side of the stopper 14, and then the knob 33 is attached to the lid 8 by any suitable means, such as adhesive bonding, welding or fitting. When the knob 33 is attached to the lid by fitting, for example, a projection formed on the knob 33 is fitted in a recess corresponding to the projection formed in the upper surface of the lid 8. The lid 8 is formed so that the tissue dispensing opening 7 is fully exposed when the lid 8 is moved to the open position. The lid unit 2 may be provided with a lid retaining structure as shown in FIG. 20(B) for preventing the lid 8 from slipping out of the lid supporting part 9. The lid retaining structure may comprise a stopper 14, such as a cylindrical projection, formed at the inlet side of the lid supporting part 9 in engagement with a guide groove 36 formed in the lower surface of the lid 8 as shown in FIG. 23. The position and the length of the guide groove 36 are determined so as to allow the lid 8 to move in the opening direction as far as an open position where the lid 8 fully uncovers the tissue dispensing opening 7, to restrain the lid 8 from moving in the opening direction beyond the open position and to enable the lid 8 to move to the closed position where the lid 8 covers the tissue dispensing opening 7 perfectly. When the lid 8 shown in 20(A) is moved to the open position where the lid 8 fully uncovers the tissue dispensing opening 7 to enable the wet tissue to be taken out through the tissue dispensing opening 7, the front end of the guide groove 36 of the lid 8 strikes against the stopper 14 and the lid 8 is in sliding engagement with the lid supporting part 9 as shown in FIG. 20(B) and thereby the lid 8 is restrained from slipping out of the lid supporting part 9.

The tissue dispensing opening 7 of the packet of the present invention may be of any shape and any construction, provided that the wet tissues contained in the pouch 1 can be taken out through the tissue dispensing opening 7. For example, the tissue dispensing opening 7 may be formed in a simple circular shape or a simple square shape. Preferably, the tissue dispensing opening 7 is formed in the least possible size necessary for dispensing the wet tissues in view of sealing performance of the pouch 1. More concretely, when the tissue dispensing opening 7 has a circular shape or a square shape, the tissue dispensing opening 7 may be formed in a size necessary only to allow two finger tips to be put into the pouch 1 to nip the wet tissue therebetween.

Although the tissue dispensing opening 7 may be formed in a simple circular shape or a simple square shape, it is preferable to form the tissue dispensing opening 7 in a shape and construction allowing the dispensing of the wet tissues in a pop-up dispensing system. The pop-up dispensing system makes the upper leaf of a folded wet tissue to pop up when a wet tissue overlying the former is taken out of the pouch 1. When the pop-up dispensing system is employed, the wet tissues are stacked to enable dispensing in the pop-up dispensing system. When the pop-up system is employed, a portion of the upper leaf of the top folded wet tissue extends outside through the tissue dispensing opening 7, which facilitates seizing and drawing out the wet tissue. As shown in FIG. 3, a tissue dispensing opening 7 for a pop-up dispensing system may have a comparatively large central section 7*a*, comparatively large end sections 7*b*, and comparatively narrow sections 7*c* extending between the central section 7*a* and the end sections 7*b*. The narrow sections 7*c* apply a moderate resistance against the wet tissue being pulled out to enable the upper leaf of the underlying wet tissue to pop up. A tissue dispensing opening for a pop-up dispensing system may be of any suitable shape and construction other than that shown in FIG. 3, provided that the tissue dispensing opening is able to apply a moderate resistance against the wet tissue being pulled out. For example, the tissue dispensing opening may be a wavy slit. When the packet of the present invention is formed for a pop-up dispensing system, fingers need not be inserted through the tissue dispensing opening into the pouch to pull out the wet tissue. Therefore, the tissue dispensing opening can be formed in the smallest necessary size, so that the unnecessary volatilization of the chemicals and the cosmetic materials impregnated into the wet tissues can be further effectively prevented.

In the packet of the present invention, it is preferable to support the lid 8 above the tissue dispensing opening 7 on the lid supporting part 9 so that a space 30 for containing a portion of the wet tissue projecting outside from the tissue dispensing opening 7 is formed between the tissue dispensing opening 7 and the lid 8. The size of the space 30 can be properly determined by properly determining the vertical distance between the upper surface of the base plate 6 in which the tissue dispensing opening 7 is formed and the lower surface of the lid 8, and the horizontal distances between the tissue dispensing opening 7 and the lid supporting part 9. Although the space 30 may be omitted and the lid 8 may be supported so as to slide horizontally along the upper surface of the base plate 6, it is preferable to form the space 30 when a pop-up system is employed. When the lid unit 2 is provided with the inner wall 13 between the lid supporting part 9 and the tissue dispensing opening 7 as shown in FIG. 3, the size of the inner wall 13 is determined so that a space 30 capable of containing a portion of the wet tissue projecting outside from the tissue dispensing opening 7 is defined by the lid 8 at the closed position and the inner wall 13 as shown in FIG. 2.

Figure 16:
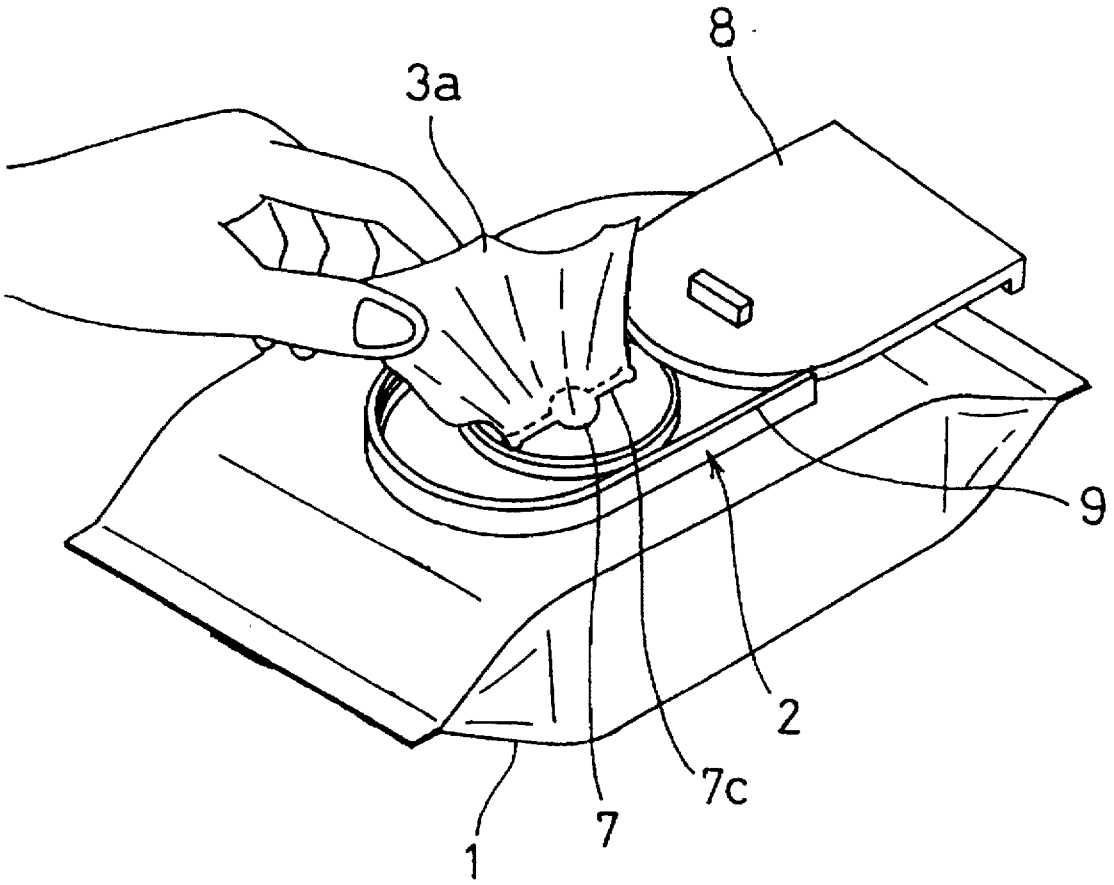
FIG. 16 is a perspective view of a packet for wet tissue in accordance with the present invention, in which a tissue is being pulled out from the packet.

When taking out a wet tissue from the packet of a pop-up system shown in FIG. 3, first the lid 8 is moved in the direction of the arrow a (FIG. 2) to uncover the tissue dispensing opening 7. The tissue dispensing opening 7 of a new packet is closed by a seal to seal the wet tissues hermetically in the pouch 1, so the seal is removed when using the packet for the first time. Then, the top wet tissue 3*a* is pulled out as shown in FIG. 16. The upper leaf of the second top wet tissue underlying the top wet tissue 3*a* overlapping the lower leaf of the top wet tissue 3*a* is pulled upward together with the top wet tissue 3*a*. The top wet tissue 3*a* is separated from the second top wet tissue after the top wet tissue 3*a* has passed through the tissue dispensing opening 7 and a portion of the upper leaf of the second top wet tissue has been pulled out through the tissue dispensing opening 7. Since the tissue dispensing opening 7 has the narrow sections 7*c*, a moderate resistance acts on the upper leaf of the second top wet tissue to separate the upper leaf of the second top wet tissue from the top wet tissue. Consequently, the second top wet tissue stays in the pouch 1 with a portion of its upper leaf projecting outside through the tissue dispensing opening 7. The portion of the upper leaf of the second top wet tissue projecting outside through the tissue dispensing opening 7 facilitates pulling out the second top wet tissue. The lid 8 is moved for closing in the direction of the arrow b (FIG. 2). When the lid 8 is fully closed, the tissue dispensing opening 7 is covered with the lid 8, the lid 8 is fitted in the groove of the lid supporting part 9 and the lid 8 is in contact with the entrance threshold 9*f* to seal the pouch 1 perfectly, so that the volatilization of the chemicals and the cosmetic materials impregnated into the wet tissues can be prevented. When the lid 8 is closed, the portion of the wet tissue projecting outside through the tissue dispensing opening 7 is contained in the space 30 between the lower surface of the lid 8 and the tissue dispensing opening 7. Therefore, the portion of the wet tissue projecting outside through the tissue dispensing opening 7 is contained in the space 30 and will not interfere with the lid 8. The space 30 may be formed in a shape and size capable of substantially containing a portion of the wet tissue projecting outside through the tissue dispensing opening 7 and need not be capable of containing the portion of the wet tissue without deforming or crumpling the portion of the wet tissue; the space 30 may be such as capable of containing the crumpled portion of the wet tissue therein.

In the lid unit 2 of the present invention, a portion of the base plate 6 in which the tissue dispensing opening 7 is formed may be on the same level as the other portion of the lid base plate 6 as shown in FIGS. 2, 17(A) and 17(B) or may be on a level below that of the other portion as shown in FIGS. 17(C) and 21. When the tissue dispensing opening 7 is formed as shown in FIGS. 17(C) and 21, the lid unit 2 can be formed in a comparatively small height, and a sufficiently large space 30 can be secured between the tissue dispensing opening 7 and the lid 8.

In a lid unit according to the present invention, a tissue dispensing member provided with a tissue dispensing opening may be attached to a base plate instead of forming the tissue dispensing opening in the base plate. The tissue dispensing member may be attached to the base plate by any suitable means, provided that the tissue dispensing member does not come off the base plate when the wet tissue is pulled out through the tissue dispensing opening formed in the tissue dispensing member; for example, the tissue dispensing member may be held in place on the base plate with retaining projections formed on the base plate, may be pressed in an opening formed in the base plate or may be screwed in a threaded hole formed in the base plate.

Figure 5:
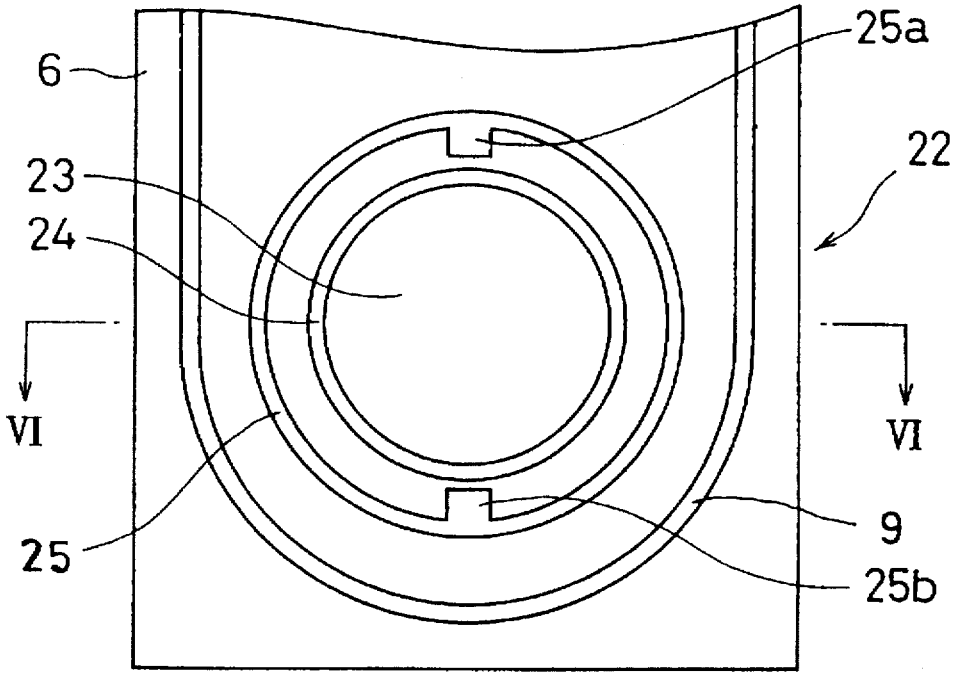
FIG. 5 is a plan view of a base plate in a lid unit included in a packet for wet tissue in a second embodiment according to the present invention.
Figure 6:
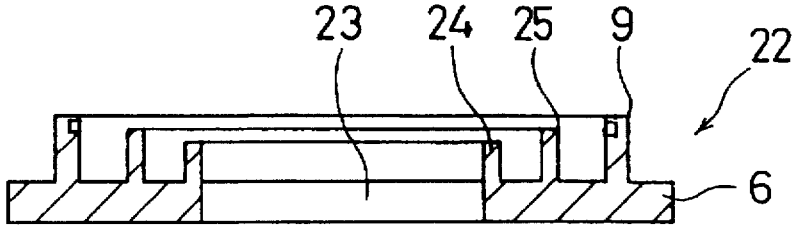
FIG. 6 is a longitudinal sectional view taken on line VI—VI in FIG. 5.
Figure 7:
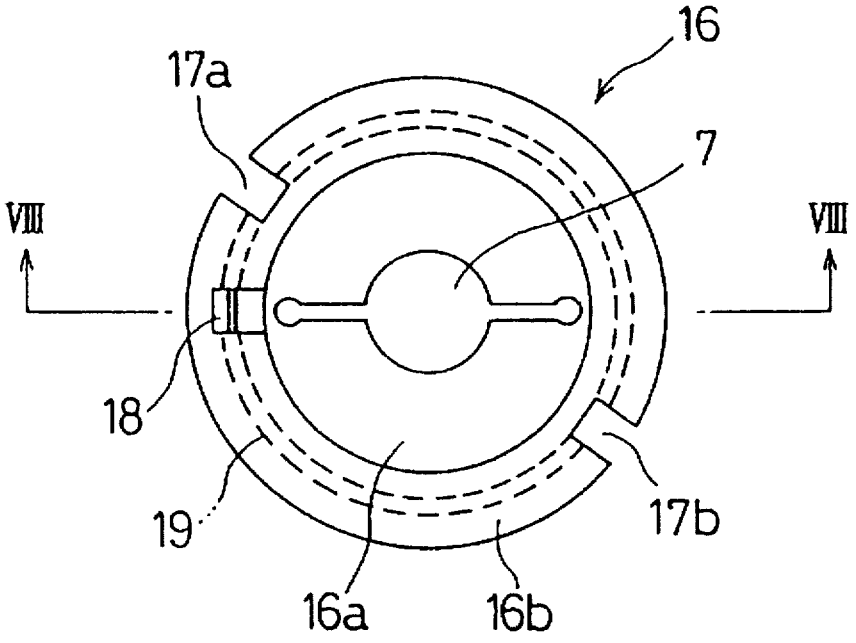
FIG. 7 is a plan view of a tissue dispensing member.
Figure 8:
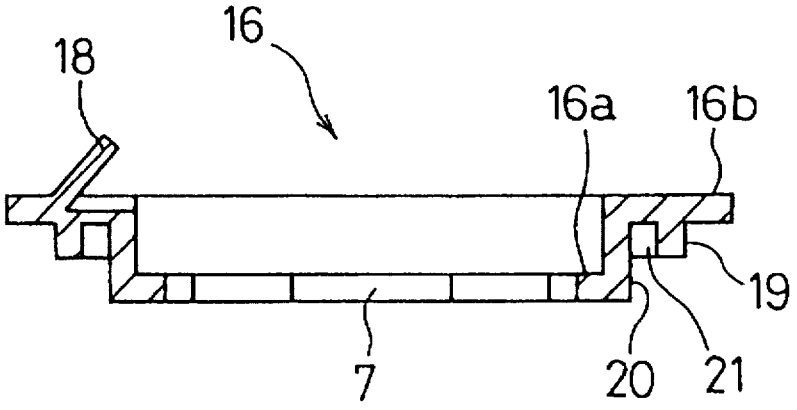
FIG. 8 is a longitudinal sectional view taken on line VIII—VIII in FIG. 7.
Figure 9:
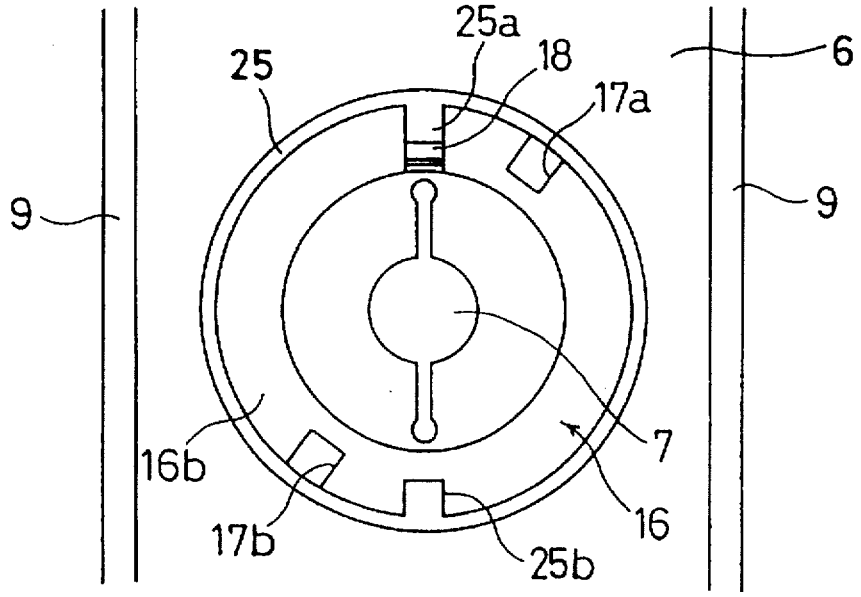
FIG. 9 is a plan view of the tissue dispensing member as mounted on the base plate.
Figure 10:
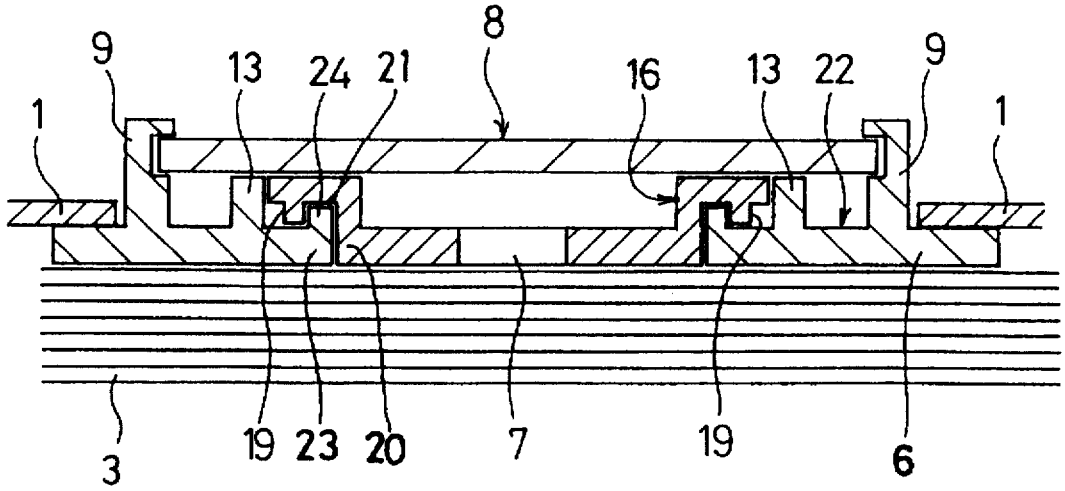
FIG. 10 is a longitudinal sectional view of a packet for wet tissue in the second embodiment provided with the lid unit of FIG. 5.

FIGS. 7 and 8 shows, by way of example, a tissue dispensing member 16 provided with a tissue dispensing opening and to be held on the base plate with a projection. Referring to FIGS. 7 and 8, the tissue dispensing member 16 formed in a generally round shape has a flat bottom wall 16*a* provided with a tissue dispensing opening 7, a side wall 20, and a flange 16*b* formed at the upper end of the side wall 20 and provided with a pair of diametrically opposite recesses 17*a* and 17*b*, a lug 18 formed near the recess 17*a*, and a circular wall 19 formed on the lower surface thereof so as to form an annular groove 21 between the circular wall 19 and the side wall 20. The tissue dispensing member 16 is incorporated into a main member 22 of a lid unit as shown in FIGS. 5 and 6. As shown in FIG. 5, the base plate 6 of the main member 22 is provided with an opening 23 for receiving the tissue dispensing member 16 therein, a circular wall 24 formed around the opening 23, a circular wall 25 formed around and concentric with the circular wall 24 and provided on its inner surface with a pair of diametrically opposite projections 25*a* and 25*b*, and a lid supporting part 9 formed around the circular wall 25. When incorporating the tissue dispensing member 16 into the main member 22, the tissue dispensing member 16 is positioned so that the recesses 17*a* and 17*b* thereof coincide with the recesses 25*a* and 25*b* of the circular wall 25, and then the side wall 20 of the tissue dispensing member 16 is pressed in the opening 23 of the base plate 6. Consequently, as shown in FIG. 10, the side wall 20 of the tissue dispensing member 16 is fitted closely in the opening 23, the circular wall 24 of the base plate 6 is received in the annular groove 21 of the tissue dispensing member 16, and the circular wall 19 of the tissue dispensing member 16 and the annular wall 24 of the base plate 6 are engaged. Then, the tissue dispensing member 16 is turned through an appropriate angle relative to the base plate 6. Consequently, the recesses 17*a* and 17*b* of the tissue dispensing member 16 are dislocated from the positions corresponding to the projections 25*a* and 25*b*, and the projections 25*a* and 25*b* engage with the flange 16*b* as shown in FIG. 9 to hold the tissue dispensing member 16 on the base plate 6, so that the tissue dispensing member 16 cannot be pulled out of the base plate 6.

Figure 15:
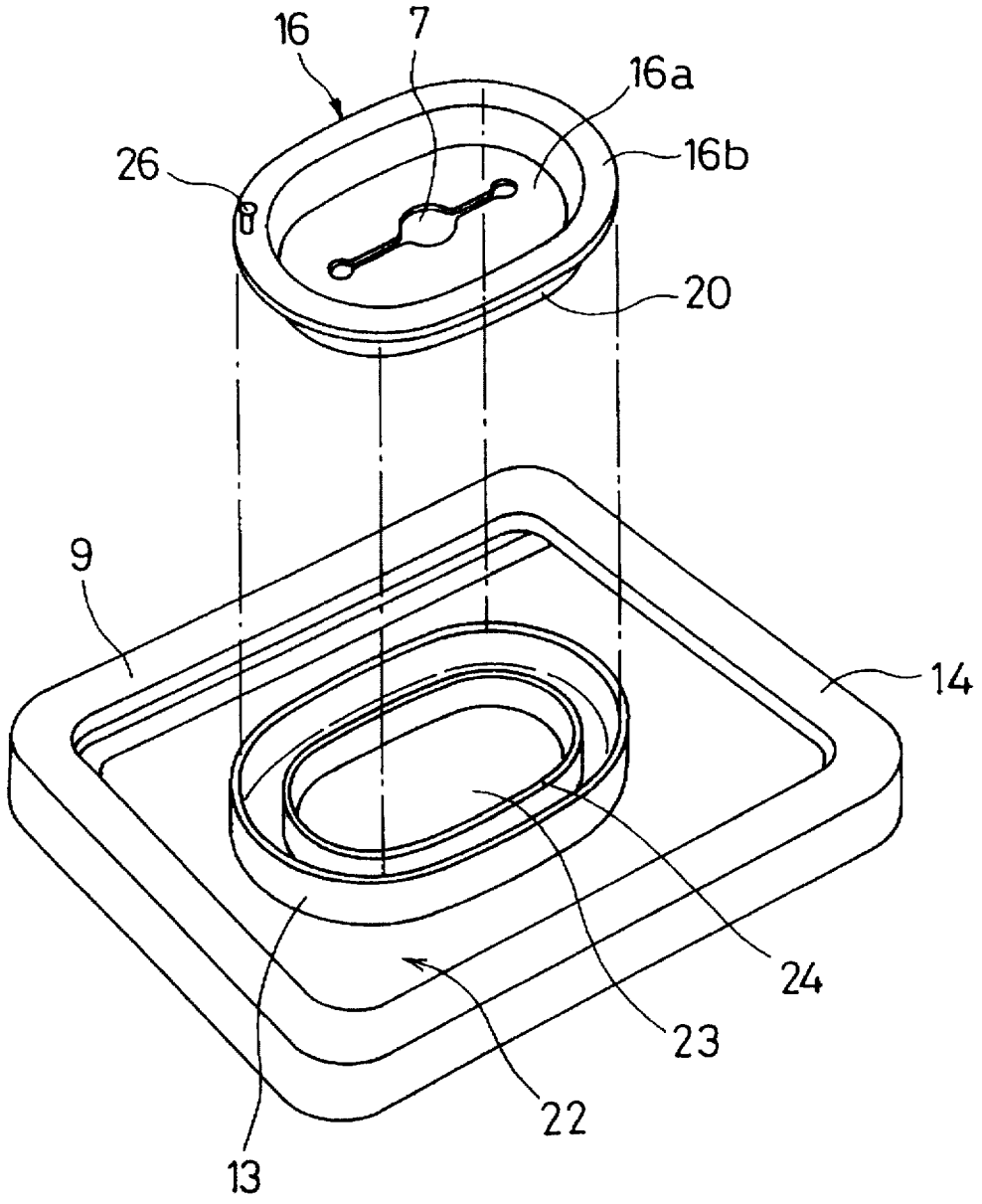
FIG. 15 is an exploded perspective view in explaining a method of mounting the tissue dispensing member of the lid unit of FIG. 11 on the base plate of the same.

FIGS. 13 and 15 show a tissue dispensing member 16 provided with a tissue dispensing opening 7 and intended to be forcibly fitted in an opening formed in a base plate. Referring to FIG. 15 showing a lid unit, the substantially oval tissue dispensing member 16 has a bottom wall 16*a* provided with the tissue dispensing opening 7, a substantially oval side wall 20, a substantially oval flange 16*b*, and a knob 26 formed on the upper surface of the flange 16*b*. A main member 22 has an oval upright wall 24 defining an oval opening 23. The side wall 20 of the tissue dispensing member 16 is fitted forcibly in the opening 23 of the main member 22 in a press-fit, so that the side wall 20 of the tissue dispensing member 16 and the upright wall 24 of the main member 22 are engaged with each other firmly. The degree of the press-fit between the side wall 20 of the tissue dispensing member 16 and the upright wall 24 of the main member 22 is such that the tissue dispensing member 16 will not be separated by a force that may act upward on the tissue dispensing member 16 when the wet tissue is pulled out through the tissue dispensing opening 7.

As shown in FIG. 15, in which the lid and the stopping recess are omitted, the tissue dispensing member 16 can be removed from the main member 22 by holding the knob 26 formed on the flange 16*b* of the tissue dispensing member 16 between the fingers and pulling the knob 26 upward. The length of the knob 26 is determined so that the knob 26 may not project upward beyond a plane including the upper end of an inner wall 13 when the tissue dispensing member 16 is mounted on the main member 22. Therefore, the knob 26 does not interfere with the lid 8.

Sometimes it occurs, when pulling out a wet tissue from the packet of a pop-up system, that a portion of the second top wet tissue cannot be accidentally pulled out of the pouch 1 through the tissue dispensing opening 7 when the top wet tissue is pulled out of the pouch 1, causing difficulty in pulling out the second top wet tissue. In such a case, the tissue dispensing member 16 exerts its effect. When such a trouble occurs in the packet provided with the tissue dispensing member 16 shown in FIGS. 9 and 10, the tissue dispensing member 16 can be easily removed from the base plate 6 by turning the tissue dispensing member 16 to position the recesses 17*a* and 17*b* to accord with the projections 25*a* and 25*b*, respectively, holding the lug 18 between the fingers and pulling up the lug 18. When such a trouble occurs in the packet provided with the tissue dispensing member 16 shown in FIGS. 13 and 15, the tissue dispensing member 16 can be remove from the base plate 6 by holding the knob 26 between the fingers and pulling up the knob 26 to remove the tissue dispensing member 16 forcibly from the base plate 16.

Since the opening 23 is large enough to receive the fingers therethrough, a portion of the wet tissue is picked up and inserted in the tissue dispensing opening 7 of the tissue dispensing member 16 by fingers so that an appropriate length of the wet tissue projects from the tissue dispensing member 16, and then the tissue dispensing member 16 is fitted again in the opening 23. Consequently, the remaining wet tissues can be pulled out of the pouch 1 through the tissue dispensing opening 7.

What is claimed is:

1. A packet for wet tissue comprising:

a pouch formed of an impervious film;

a stack of wet tissues contained in the pouch; and a lid unit fitted in an opening formed in the pouch and attached to the pouch, said lid unit including a base plate having a tissue dispensing opening and a lid supporting part with a groove, and a lid horizontally slidably supported on the lid supporting part so as to cover and uncover the tissue dispensing opening, said lid having side edges slidably fitted in the groove of the lid supporting part.

2. A packet for wet tissue according to claim 1, wherein said tissue dispensing opening of the lid unit has a shape and construction such that when a wet tissue is take out through the tissue dispensing opening, a top part of a subsequent wet tissue is pulled out from the pouch and located inside the tissue dispensing opening.

3. A packet for wet tissue according to claim 2, wherein the shape and construction of the tissue dispensing opening are designed so as to apply a moderate resistance to the wet tissue being pulled out through the tissue dispensing opening.

4. A packet for wet tissue according to claim 3, wherein the tissue dispensing opening has narrow sections capable of applying a moderate resistance to the wet tissue being pulled out through the tissue dispensing opening.

5. A packet for wet tissue comprising:

a pouch formed of an impervious film;

a stack of wet tissues contained in the pouch; and a lid unit fitted in an opening formed in the pouch and attached to the pouch, said lid unit including a base plate having a tissue dispensing opening and a lid supporting part with longitudinal tongues on opposite sides thereof, and a lid horizontally slidably supported on the lid supporting part so as to cover and uncover the tissue dispensing opening, said lid having longitudinal grooves on opposite sides thereof slidably receiving the longitudinal tongues therein.

6. A packet for wet tissue according to claim 5, wherein said lid unit further includes means for engaging the lid with the lid supporting part when the tissue dispensing opening is completely closed by the lid.

7. A packet for wet tissue according to claim 6, wherein said lid unit further includes means for preventing the lid from disengaging from the lid supporting part when the tissue dispensing opening is uncovered by the lid.

8. A packet for wet tissue according to claim 7, wherein said engaging means is a projection and a dent formed in the lid and the base plate, and said preventing means includes a projecting member formed on the lid and engaging the base plate.

9. A packet for wet tissue comprising:

a pouch formed of an impervious film;

a stack of wet tissues contained in the pouch; and a lid unit fitted in an opening formed in the pouch and attached to the pouch, said lid unit including a base plate having a tissue dispensing opening and a lid supporting part; a lid horizontally slidably supported on the lid supporting part so as to cover and uncover the tissue dispensing opening; and a space formed between the lid and the tissue dispensing opening when the lid is at a closed position to cover the tissue dispensing opening, said space being large enough to substantially contain a portion of the wet tissue projecting outside through the tissue dispensing opening.

* * * * *